3/24/87 XR 4,651,432

United States Patent [19]

Bornancini

[11] Patent Number: 4,651,432

[45] Date of Patent: Mar. 24, 1987

[54] AIMING SYSTEM ADAPTED FOR USE IN COMPETITION REVOLVERS ENABLING VARIED AND BROAD ADJUSTMENT

[75] Inventor: Jose C. M. Bornancini, Porto Alegre, Brazil

[73] Assignee: Forjas Taurus S/A, Porto Alegre, Brazil

[21] Appl. No.: 835,094

[22] Filed: Feb. 28, 1986

[51] Int. Cl.[4] ..... F41G 1/00; F41G 1/10; F41G 1/26

[52] U.S. Cl. ..... 33/233; 33/251; 33/257

[58] Field of Search ..... 33/233, 243, 251, 252, 33/254, 257, 258, 260; 42/1 S

[56] References Cited

U.S. PATENT DOCUMENTS

| | | | |
|---|---|---|---|
| 2,187,096 | 1/1940 | Pomeroy | 33/257 |
| 2,377,704 | 6/1945 | Loomis | 33/252 |
| 2,842,848 | 7/1958 | Friedrichsmeier | 33/243 |
| 3,495,339 | 2/1970 | Elliason | 33/257 |
| 3,942,256 | 3/1976 | Khaidurov et al. | 33/257 |
| 4,127,943 | 12/1978 | Tiritilli | 33/260 |
| 4,192,075 | 3/1980 | Strahan | 33/233 |
| 4,208,821 | 6/1980 | Power | 33/254 |
| 4,551,920 | 11/1985 | Mahotra | 33/252 |

*Primary Examiner*—Richard R. Stearns
*Attorney, Agent, or Firm*—Anthony A. O'Brien

[57] ABSTRACT

An aiming system adapted for use in competition revolvers incorporated in the upper portion of the revolver and includes a heavy steel rib along which the various components of the system, namely, the rear sight, the front sight, and an auxiliary weight, can be displaced and fixed in desired positions. The rear sight is micrometrically adjustable in height, direction and opening of the rear sight slot and the front sight is constructed and arranged for receiving interchangeable inserts.

6 Claims, 31 Drawing Figures

FIG. 2
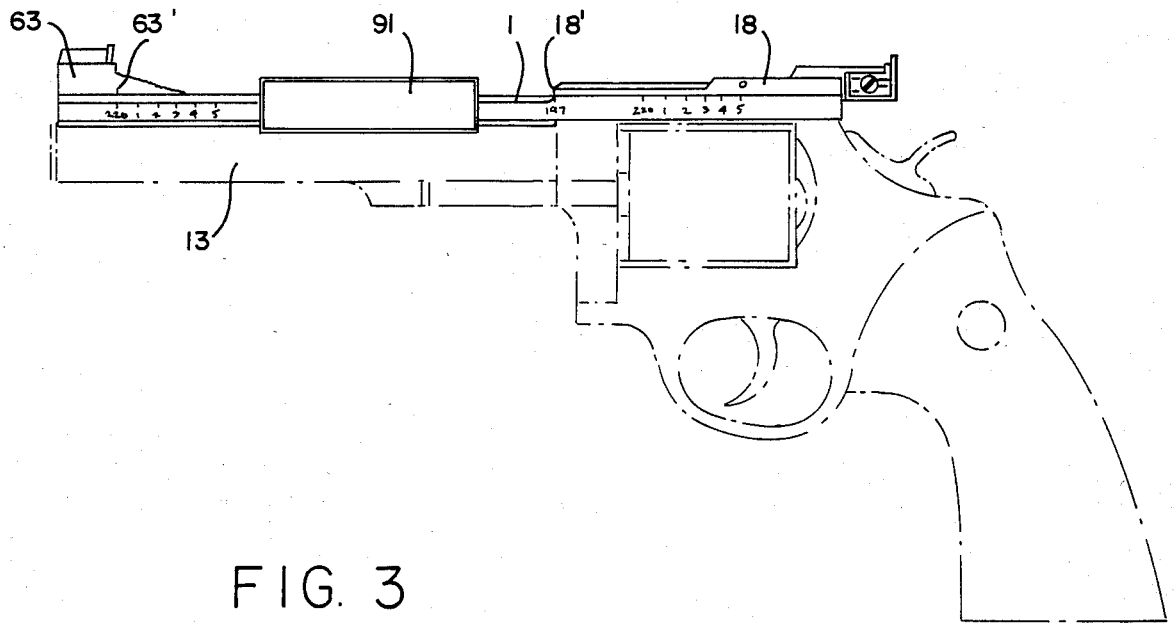
FIG. 3
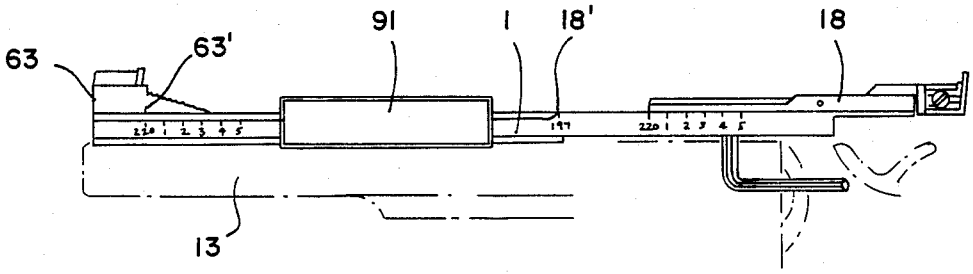
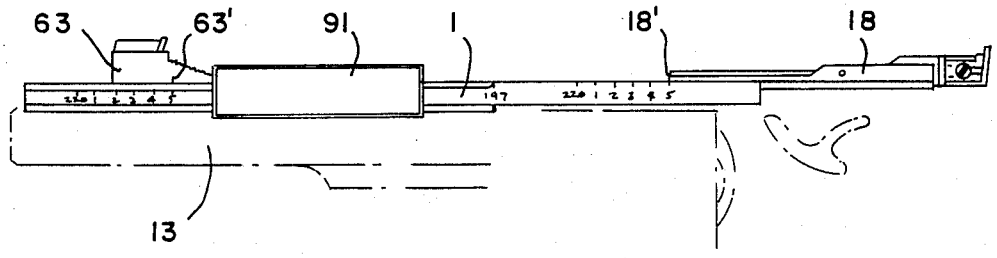
FIG. 4

FIG. 13
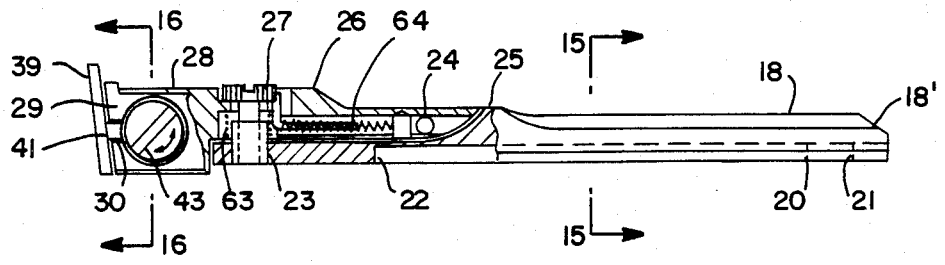
FIG. 14
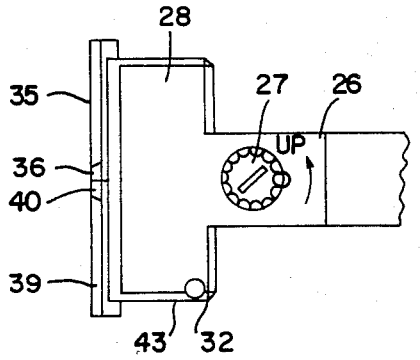
FIG. 15
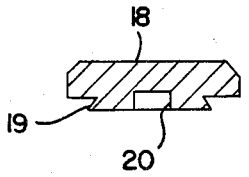
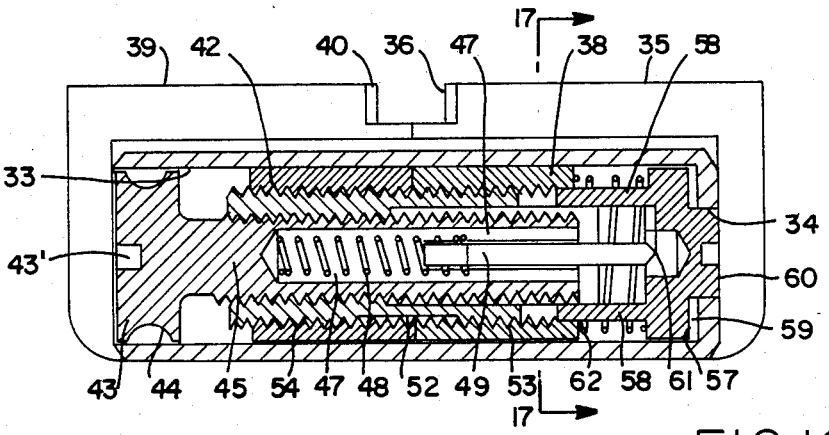
FIG. 16
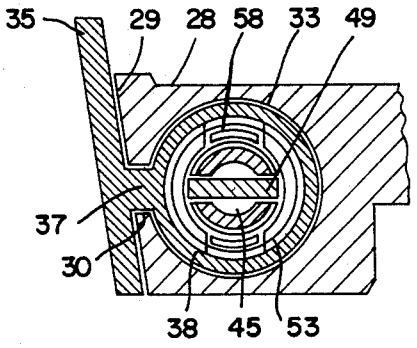
FIG. 17

AIMING SYSTEM ADAPTED FOR USE IN COMPETITION REVOLVERS ENABLING VARIED AND BROAD ADJUSTMENT

BACKGROUND OF THE INVENTION

There is a great variety of revolvers and pistols employing ribs along the upper portion of the respective barrels.

Some of these ribs have a purely aesthetical purpose, but when they are correctly set, they are extremely functional in that they create a sight plan which facilitates the aiming of the pistol at the target. In some instances, these ribs are even ventilated so as to avoid aiming deformations caused by the convective movement of air when in direct contact with the heated barrel for successive firings.

In certain instances, the ribs are an integral part of the firearm as in the revolvers: Colt Python, Aminius Target, H & R - 999, Dan Wesson, S & W K 22 and the like. In other instances, they are accessories which can be adapted to certain firearms models such as BO-MAR-RIBS adapted to the Colt Mod. 1911 pistols. Lastly, there are ribs which are extremely sophisticated and which are handmade by American armorers who design revolvers specifically intended for certain types of competitions practiced almost exclusively in the United States of America.

The object of this invention is to provide a prefabricated and associated components rib adapted to be mounted on competition revolvers already constructed for precision shooting and which are thereby converted in an accurate and extremely versatile instrument with a minimum of modifications in the basic firearm, enabling the more distinct adjustments and configurations compatible with the target range practice standards.

The addition of the rib and associated components renders the resulting revolver not only ideal for the more skilled and veteran shooters, but also for aspiring champions. This is because the rib permits experimental testing of the displacement of rear sight, front sight and auxiliary weight and the effects of these modifications on shooting the firearm without the need of costly, time-consuming, irreversible and sometimes disappointing intervention of armorers which would be obligatory for conventional firearms.

The only modification required to the normal basic revolver barrel is milling the upper reinforcement thereof in a dovetail shape in order to permit the rib to be inserted and firmly attached thereto.

This rib is formed by a steel rod having a prismatic shape whose forward longer portion situated over the barrel has a generally rectangular cross-section and whose rearward shorter portion has a section in the shape of an inverted U.

Along the full upper face of the rib, there is a dovetail notch, on which the bracket for the front sight, the bracket for the rear sight and the adjustable auxiliary weight are inserted and fixed into the desired positions.

Also, in the lower face of the rib, there is a dovetail notch in register with the upper reinforcement of the barrel and into which the rib is inserted until abutting against the forward face of the revolver frame bridge. The assembly is then rendered integral by two strong Allen screws. The back portion of the rib is recessed at the bottom, and it covers the frame bridge laterally from the forward face, where the barrel is fixed, to the back portion thereof.

Mounting this heavy rib by positioning it above the barrel line either with or without the auxiliary weight, raises the center of gravity of the firearm so as to minimize its rotation upwardly as caused by the firing retraction. This is because when the firearm center of gravity is raised, this approaches the retraction line thereby reducing the respective moment and therefore the primary rotation of the revolver.

It is obvious that upon encountering reaction from the shooter's arm and hand, usually situated below the retraction line, one would have a barrel raising as a final result, but the full retraction effect is thereby attenuated. This results in a stable behavior of the revolver upon firing, without the excessive movements for raising the barrel, which are particularly inconvenient in the fast shoot modes of competition. This raised positioning of the rib rendered then the addition of auxiliary weights substantially unnecessary. However, an auxiliary weight can be still added, the total weight of the firearm remaining below the allowed limit of 1400 g, with a margin for a wider and more anatomic grasping, with a prior removal of the rear sight base, the auxiliary weight is engaged into the dovetail notch in the rib upper face and it can be attached by a respective bolt in any intermediate position from the end positions.

The sights have brackets which can slide along the dovetail slot in the rib upper face and are firmly attachable in any position deemed suitable.

In order to move the front sight bracket, a screw is loosened and the front sight can slide along the rib upper notch into which it is engaged until the desired position, wherein it will be again fixed by the screw.

The rear sight bracket can be displaced by loosening the respective Allen screw after the revolver cylinder is opened. Its displacement is limited to a maximum forwardly and to a maximum rearwardly, for which position the screw itself serves as a stop or abutment which must be fully loosened when it is desired to withdraw the sight.

In order to facilitate the mutual positioning of both front and rear sights, keeping it within the range of 220 mm, as allowed by competitive target shooting standards, two scales are engraved on the rib left side face.

The front scale is used in relation to the reference line engraved in the side of the rear sight bracket and it has its starting marking as the number 220, followed by the other markings to 5.

The other scale is found on the rib back portion and its division is also marked with number 220, followed by other markings to 5, said scale being used in relation to the reference formed by the front end of the rear sight base. These markings mean that the distance between the sights is of exactly 220 mm upon fixation of the front sight bracket corresponding to marking 220 of the front scale and the rear sight bracket corresponding to the same marking in the respective scale.

After the rear and front sights are placed in correspondance with said markings in the respective scales marked with identical numbers, the 220 mm sight base will be maintained and the sights will move backwards up to the limit indicated in FIG. 4.

It is apparent that all the intermediate positions can be obtained for sight bases smaller than 220 mm as exemplified with the firearm shooter configuration indicated by mark 197 on the rib in FIG. 2.

By means of this broad adjustment of the sight base, facilitated by the settings of the rib scales, one can meet the requirements of shooters who either prefer the more retracted position of the sights in relation to the firearm handle, and those who wish this position to be the most forward possible. Thus it is possible to meet the different tendencies in relation to the distance between the sights which is preferred to be short for some and long for others provided that it remains within the set limit of 220 mm in competition.

All the relative positions for the sights and the auxiliary weight are then possible in the rib which is the object of the present invention in order to be adapted to the individual preferences of the shooters.

The rear sight is micrometrically adjustable in height and laterally by means of a screw provided with an audible click, and it further permits the micrometric adjustment of the sight notch width for opening and closing it with a clear indication of the procedure in rear sight left face. This adjustment does not alter the lateral adjustment and is rendered a valuable instrument during the competitions when there are changes in luminosity or for adaptation to the viewing conditions for the shooter.

The front sights are easily interchangeable and they are supplied in three sizes (3,5—4,0—4,5 mm) with an additional model having colored side contrast.

The exchange of the front sights is easily made by introducing a pin into the hole existing in the upper face thereof and pressing downwardly and forwardly to release them from their fixation in the base. The front sight having colored side contrast is, as the name indicates, a classical Patridge type front sight with an acrylic insert providing a lateral contrast in deep color, without depending upon the target whiteness to permit the correct division of the sights. Thus, the shooter can keep aiming with which he is habituated even when the background is dark and therefore this front sight with side contrast is specially adapted to silhouette shooting or to those shooters who prefer aiming at the black center of the target and not at the 6 o'clock position. In both cases, the black background does not provide a contrast for the ordinary sights and emergency means with white paining on the front sight are used.

The Patridge type front sight with colored side contrast also offers a net advantage over those having colored inserts on the front sight itself, which, during competition shooting, lead to different results as a function of the illumination conditions. This is because the latter receive direct light impingement and thereby produce a glow causing low shots and when the illumination is from forward, do not produce the desired result for being seen in silhouette, which prevents the color of the insert from being perceived.

Other high visibility systems are also used by other manufacturers such as a colored spot on the front sight and a vertical bar or two spots on the rear sight, but they are more specifically adapted to night shooting. Besides not providing for the same accuracy in competition as the Patridge type sights, these systems present the same drawback of the colored insert on the front sight end when the same is seen in silhouette under normal illumination conditions of the shooting stands in which the light comes from forward.

It is believed that these and other objects and advantages of the present invention will be readily apparent from the following description of a preferred embodiment thereof when taken in connection with the attached drawings which are illustrative rather than limitative of the invention and wherein:

FIG. 2 is a side elevational view of the rib showing the engraved scales and the sights in the position of the aiming base of 197 mm;

FIG. 3 is a side elevational view showing the sights in the position of the aiming base of 220 mm;

FIG. 4 is a view similar to FIGS. 2 and 3 but with the sights in the more retracted position with the aiming base of 220 mm;

FIG. 13 is a side elevational view, partly in section, of the rear sight mounted on its respective insertion bracket;

FIG. 14 is a fragmentary top plan view of the rear sight;

FIG. 15 is a view taken along line 15—15 of FIG. 13;

FIG. 16 is a view of the rear sight taken along line 16—16 of FIG. 13;

FIG. 17 is a view taken along line 17—17 of FIG. 16;

Figure 1:
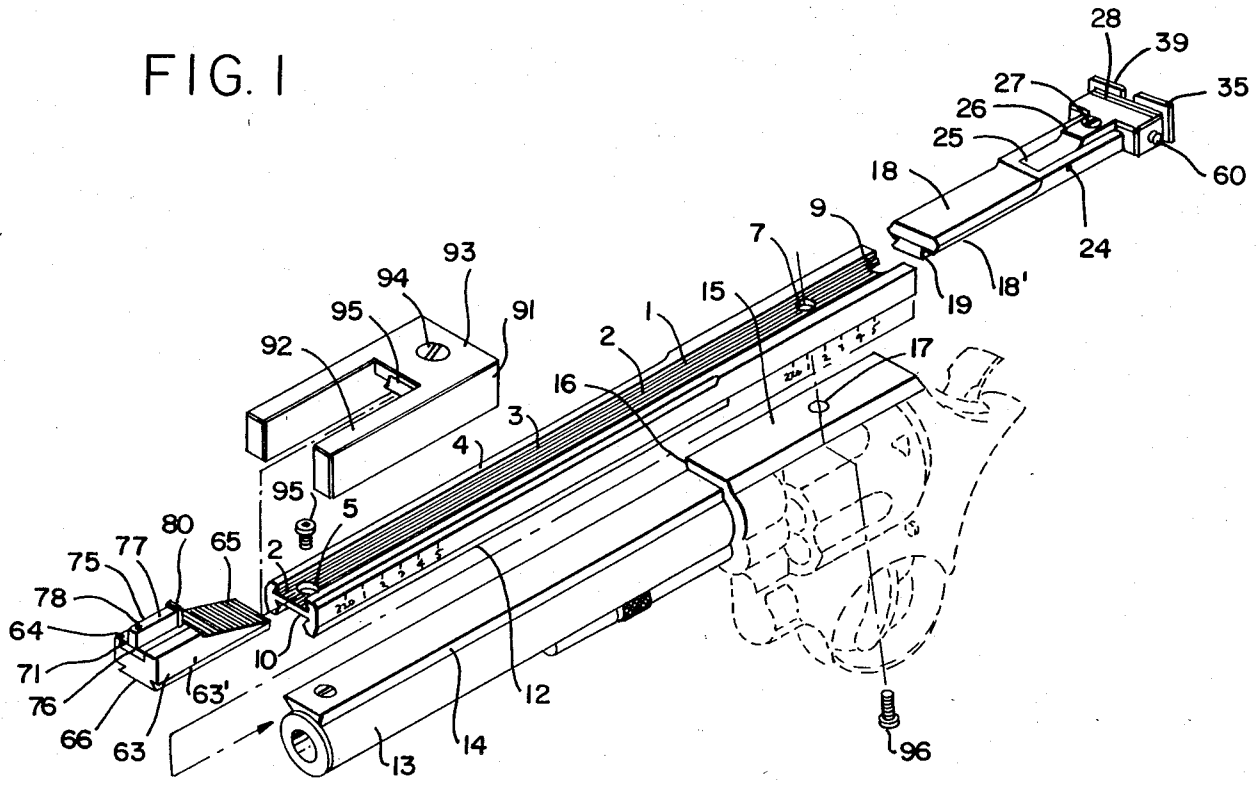
FIG. 1 is an exploded perspective view of the aiming system of the present invention showing the four components thereof; rib with a scale, rear sight, front sight and auxiliary weight in relation to the revolver barrel milled for insertion of the rib.

The basic components of the system which is the object of the present invention is rib (1), FIG. (1) and FIG. (5), which is inserted and rendered integral with the upper portion of the revolver barrel and frame.

Along the entire upper face of rib (1), a notch (2) is milled having dovetail-like section and into which the remaining components of the sytem are inserted. In order to avoid reflections, the face forming notch (2) bottom is lengthwise grooved as at (3) or made dull.

The two upper side edges (4) of rib (1) are chamfered in the extent corresponding to the length of the revolver barrel.

The face forming the bottom of notch (2) is provided with two holes (5) and (7), which are adapted to receive suitable set screws and a small notch (9) is formed in the rib end, in order to house the tip of the vertical adjustment screw (27) for rear sight (26) to be described more fully hereinafter.

A notch (10) is milled in the lower face of rib (1), this notch having a dovetail-like cross-section corresponding in an extent to the length of a rib (14) milled in the upper portion of the revolver barrel (13), onto which the rib (1) will be lengthwise inserted.

Figure 9:
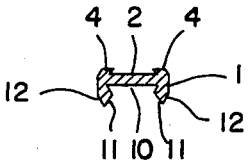
FIG. 9 is a view taken along line 9—9 of FIG. 6.
Figure 10:
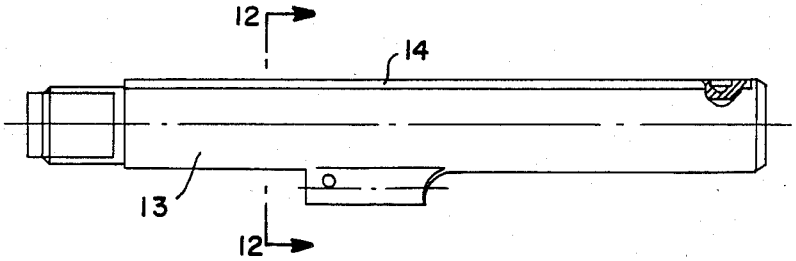
FIG. 10 is a side elevational view of the barrel partly in section for showing the rib anchoring screws.
Figure 11:
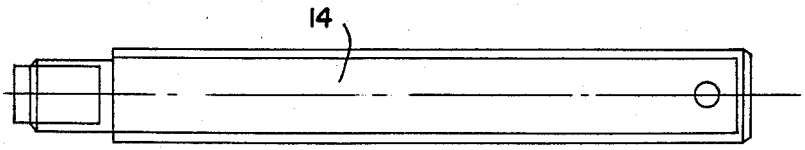
FIG. 11 is a top plan view of the barrel.
Figure 12:
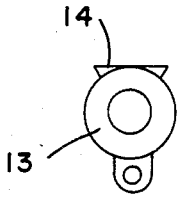
FIG. 12 is a view taken along line 12—12 of FIG. 10.
Figure 18:
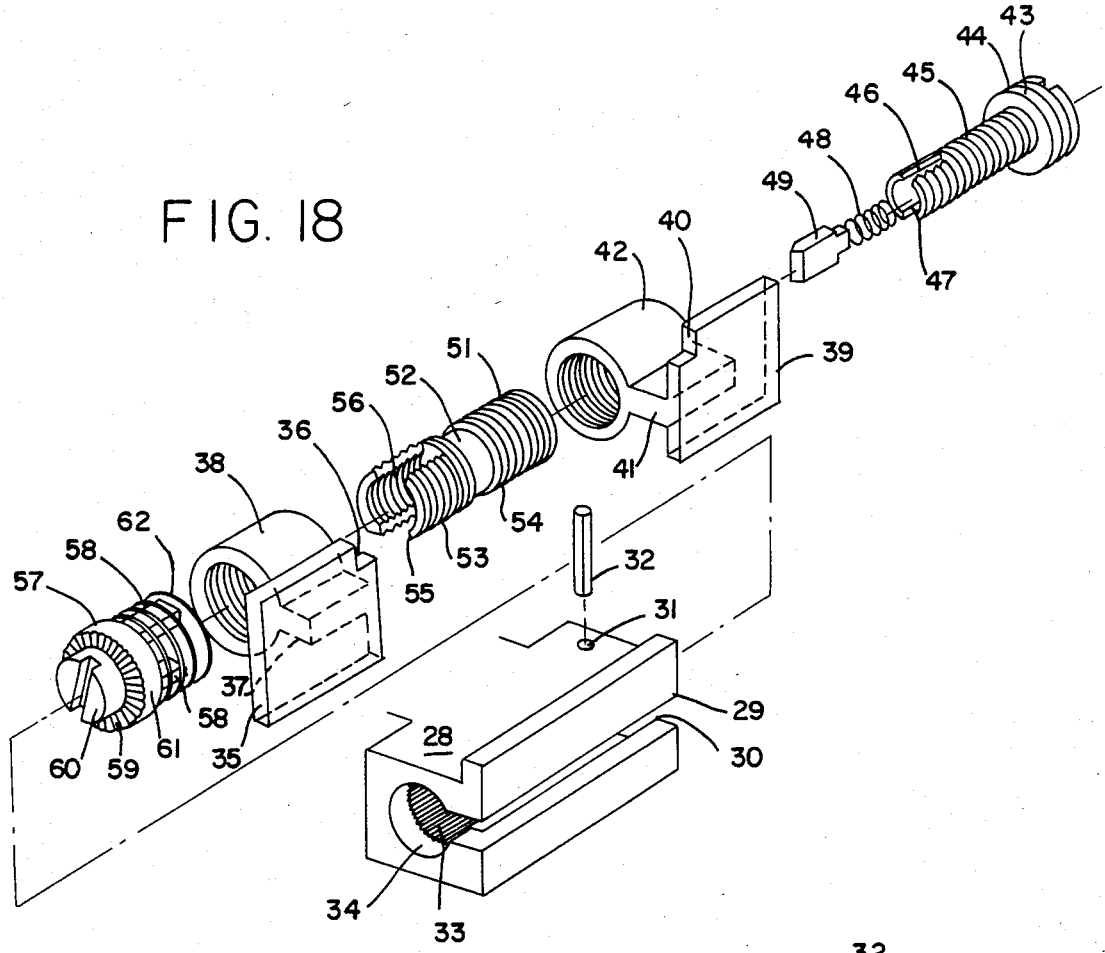
FIG. 18 is an exploded perspective view of the rear sight, seen from the right side of FIG. 16.

The lower portion of rib (1) corresponding to the barrel length is also machined over the lower internal edges (11) (FIG. 9) so as to be adapted to the barrel contour, and the external lower edges (12) of rib (1) are chamfered in the same extent.

Figure 5:
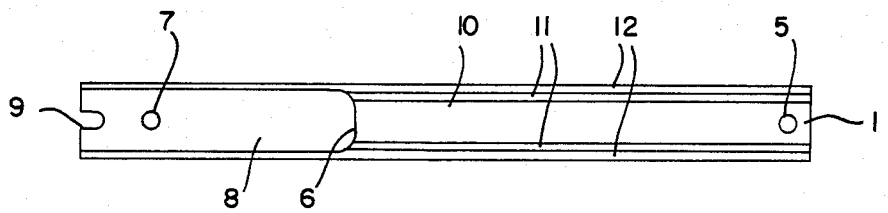
FIG. 5 is a bottom plan view of the rib.
Figure 6:
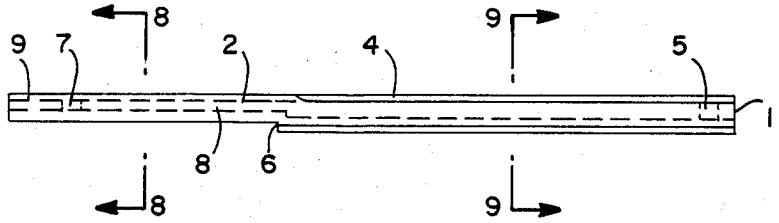
FIG. 6 is a side elevational view of the rib.
Figure 7:
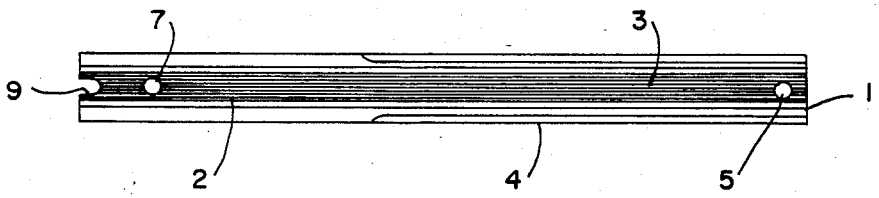
FIG. 7 is a top plan view of the rib.
Figure 8:
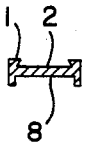
FIG. 8 is a view taken along line 8—8 of FIG. 6.

As will be seen in FIGS. 5 and 6, the rear portion of rib (1) is milled in the lower face to form a notch (8) having a rectangular configuration and a cross-sectional configuration of an inserted U, as shown in FIG. 8, having parallel side walls adapted to engage and cover the "bridge" (15) (FIG. 1) of the revolver frame on which the front portion (16) thereof will abut the forward face (6) of notch (8).

After rib (1) is inserted onto the rib (14) of the barrel (13) until face (6) abuts stop (16) of the frame front portion, these two parts are integrally connected to each other by screws (95) and (96) (FIG. 1).

As it can be seen in FIGS. 1, 2, 3 and 4, two identical scales are engraved on the left side face of rib (1), starting with a marking 220 and following with markings 1 to 5. These scales are used in relation to reference (63') and reference (18') on brackets (63) and (18) of front and rear sights respectively. When the respective references are placed in coincidence with the same marking in the two scales, the aiming base (distance between the sights) corresponds to the standardized 220 mm. Therefore, this allows for five successively more retracted positions of the sights without altering the aiming base as shown in FIGS. 3 and 4. Marking 197 indicates the aiming base for the most forward position of both sights, as seen in FIG. 2. These scales are essential in competitions for controlling the distance so that it does not exceed 220 mm.

Referring to FIG. 1, the second component of the system of the present invention is the rear sight (26) and its respective bracket (18). Bracket (18) has the lower face thereof milled to form a longitudinal shoulder with a dovetail-like cross-section (19) enabling it to be inserted and slid along the corresponding notch (2) of rib (1). As will be seen in FIGS. 13 and 15, the lower face of bracket (18) is provided with a slot (20) having forward wall (21) and a rearward wall (22). The tip of screw (96) (FIG. 1) is inserted upwardly into this slot, and from the "bridge" (17) and threaded into hole (7) of rib (1). When this screw is sufficiently tightened, it urges bracket (18) upwardly, retaining it in the desired position along rib (1). Furthermore, unless it is fully loosened, screw (96) serves as a stop abutting the front wall (21) and back wall (22) of slot (20), thus preventing the rear sight bracket (18) from sliding fully and unintentionally from notch (2) of rib (1). Since the operation of screw (96) depends on the previous rotation of the revolver cylinder to the open position, FIG. 3, it is only possible to reclose the cylinder when the screw (96) has been fully tightened. Thus, screw (96) cannot be left loose and therefore bracket (18) cannot be released.

FIG. 13 shows that a further notch (25) is milled in bracket (18) for engagement of the front portion of the rear sight (26) which can rotate about a shaft (24) for height adjustment, effected by screw (27) threaded in the hole (23) and which acts against the bias of a coil spring (63) tending to push the rear sight upwards. A device (64) acts in screw (27) in order to keep it in a determined position and it produces perceivable clicks facilitating rear sight adjustment upon turning the screw. As will be seen in FIG. 14, a back portion (28) of rear sight (26) is wider than the front portion and has a prismatic shape and it houses the devices for lateral adjustment of the aiming and opening of the sight notch, as illustrated in FIGS. 16 to 19.

Part (28) has the rear face thereof (29) slightly inclined backwards and opened by a horizontal slot (30). The prismatic back portion (28) has a cylindrical base (33) at the right side face thereof, the bore communicating with a hole (34) of smaller diameter formed in the opposite side face of the base portion.

The rear sight plate is divided into two symmetrical portions (35) and (39) which are joined by respective ribs (37) and (41) to cylindrical bodies (38) and (42) whose external diameter corresponds to bores (33) and which are internally threaded in opposite directions. Each of the half plates (35) and (39), has respectively a half notch (36) and (40) open at the upper portion thereof. The two half plates (35) and (39) of rear sight are screwed by the respective cylindrical bodies (38) and (42) onto the corresponding portions (53) and (54) of a member (51) having compatible threads separated by a smooth cylindrical portion (52). Member (51) has an internally threaded through-bore (56) and whose left end has two cutouts (55). A horizontal adjustment screw (45) is inserted into the internal threads of member (51) and the head (43) of said screw is provided with a slot (43') and an annular notch (44). Screw (45) has a partial bore (47) in the axial direction to house spring (48) biasing member (49), for providing for the clicks of direction adjustment.

Figure 19:
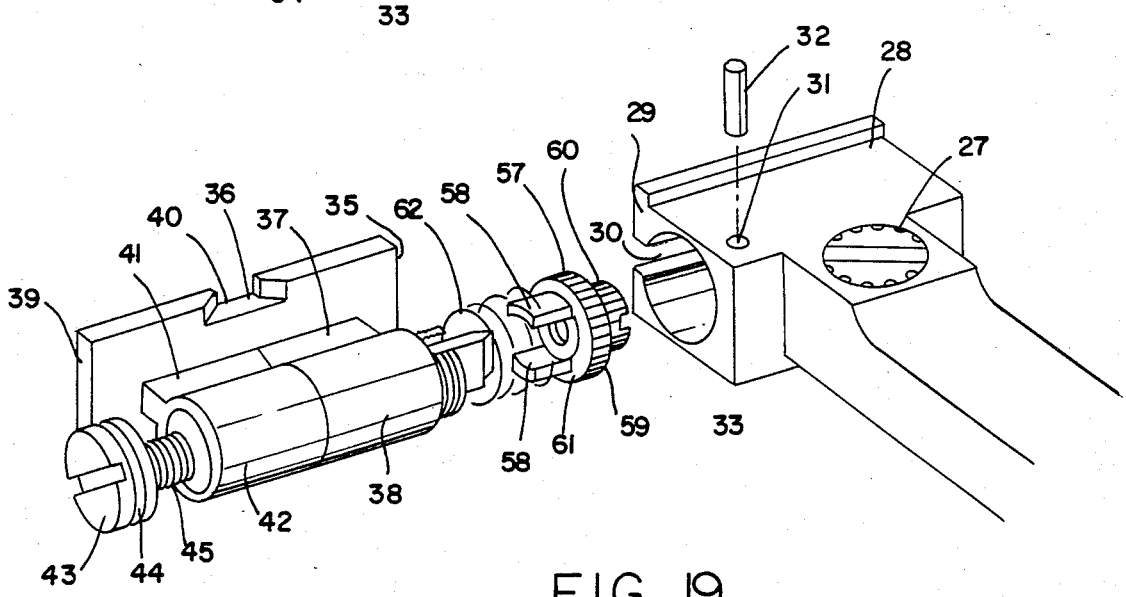
FIG. 19 is an exploded perspective view of the rear sight seen from the left side of FIG. 16.

As seen in FIG. 19, when cylindrical bodies (38) and (42) of the two half-plates (35, 39) are simultaneously screwed over the respective threads (53) and (54) of member (51), until they are juxtaposed, screw (45) can then be inserted into the inner threaded hole (56) of member (51) until emerging at the other end thereof; spring (48), and the small plate member (49) can be then inserted into the bore (47) of screw (45).

For completing the mounting of this mechanism, prior to introducing the thus formed assembly into the cylindrical bore (33) of the rear sight body (28), spring (62) and member (57) are added to the end of said assembly, and one face of member (57) is provided with two rods (58) engaged within corresponding notches (55) in member (51). The opposite face of member (57) is in the form of an annulus (59), having radial teeth corresponding to radial teeth on the portion of the side face of the back portion (28) surrounding hole (34). A cylindrical head (60) projects from the central portion of annulus (59), this head being slotted and being visible in hole (34), at the left side of rear sight. Member (57) also has a crown (61) having radial teeth on the inner annulus between the two rods (58) on which the chamfered edge of the small plate (49) will act.

After the insertion of the complete assembly into bore (33) until head (60) emerges in hole (34), the assembly is maintained in place by introducing a pin (32) into a hole (31) on the rear sight body (28) and receivable in the annular notch (44) of head (43) of screw (45), whereby the screw (45) is permitted to rotate, but prevented from moving axially.

For moving the sight plates (35, 39) horizontally together without changing the notch width, screw (45) is caused to rotate in the direction of an arrow engraved on the respective head (43) to displace the sight rightwards and in the opposite direction to displace it leftwards. This adjustment can be made because screw (45) cannot be moved axially, because of the pin (32), while being threaded or unthreaded in member (51), which can only be moved axially since it is fixed in relation to the rotation of member (57) by means of rods (58), inserted in the respective notches (55). This in turn is due to the fact that member (57) cannot be rotated because the spring (62) biases the toothed surface (59) thereof into engagement with the toothed portion surrounding hole (34). The adjustment clocks are produced by plate (49) urged by spring (48) against the radially toothed crown (61) of member (57).

When it is desired to adjust the opening of the right sight slot without changing the aiming alignment, a screw driver is inserted in the head (60) of member (57). The teeth (59) are disengaged from the corresponding teeth in the portion surrounding the hole (34) by pushing inwardly and causing member (57) to rotate by means of rods (58) thereby causing member (51) to rotate together with threaded portions (53) and (54), causing movement of the cylindrical bodies (38) and (42), carrying the half plates (35) and (39), to move towards and away from each other, rotation of the half plates being prevented by the ribs (37) and (41) extending through slot (30). On the other hand, screw (45) will rotate along with member (57) and (51), since it is locked by engagement of plate (49) in the teeth of member (57) and therefore there is no side change in the aiming direction. Consequently, by acting on the slot of the screw (45) in the rear sight right side face, only the firing direction is adjusted whereas acting on the slot of screw (57) in the rear sight left side face, only the opening of the rear sight slot is adjusted.

Figure 20:
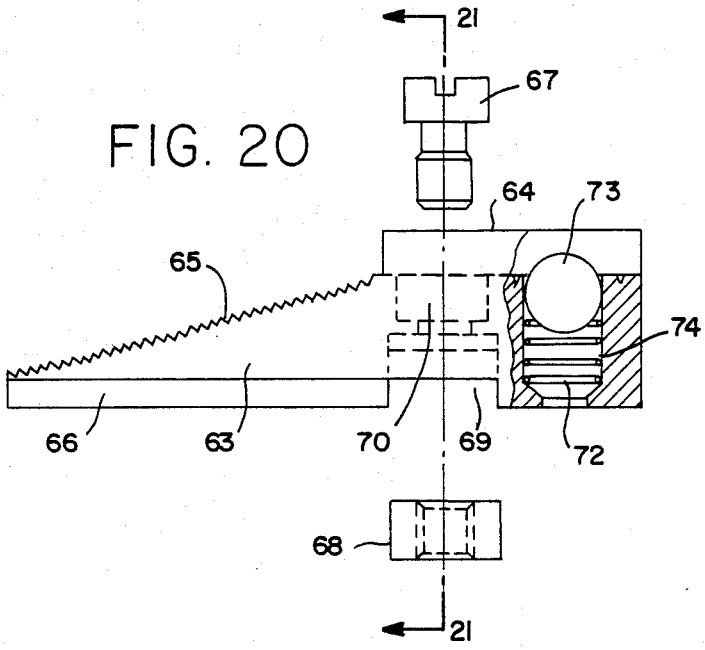
FIG. 20 is a fragmentary sectional view of the front sight insertion bracket and associated set screw and lower plate.
Figure 21:
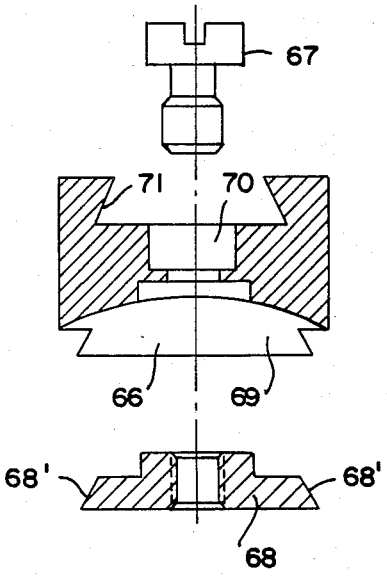
FIG. 21 is a view taken along line 21—21 of FIG. 20.
Figure 22:
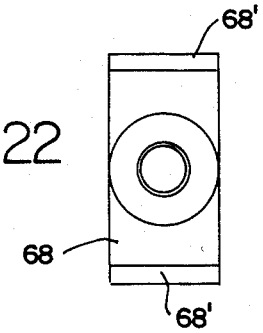
FIG. 22 is a top plan view of the lower plate.
Figure 23:
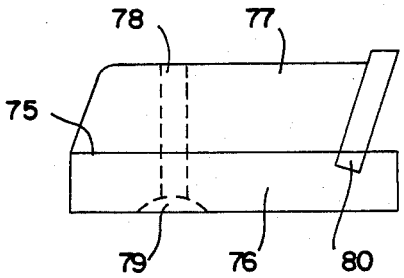
FIG. 23 is a side elevational view of an insert for the front sight.
Figure 24:
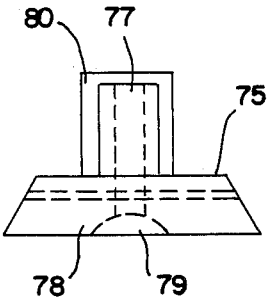
FIG. 24 is a front elevational view of the insert shown in FIG. 23.
Figure 25:
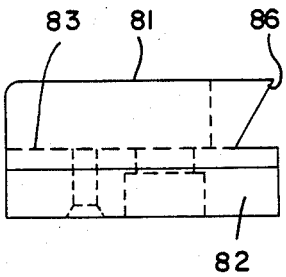
FIG. 25 is a side elevational view of another embodiment of an insert for the front sight.
Figure 26:
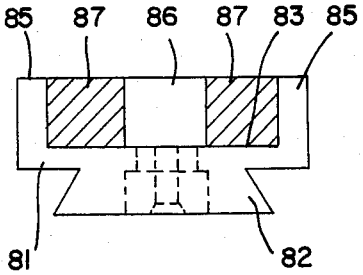
FIG. 26 is a front elevational view of the insert shown in FIG. 25.
Figure 27:
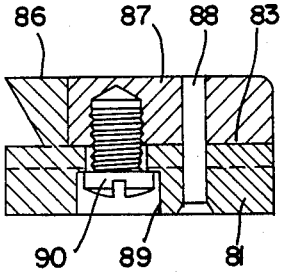
FIG. 27 is a sectional side elevational view of the insert shown in FIG. 26.
Figure 28:
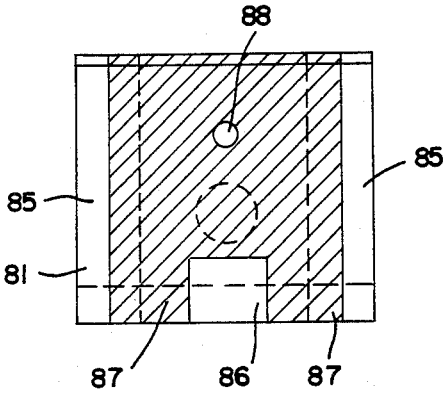
FIG. 28 is a top plan view of the insert shown in FIG. 26.

The third component of the system of the present invention is the front sight formed by the bracket, as shown in FIGS. 20 to 22 and by interchangeable inserts which can be of usual type, as shown in FIGS. 23 and 24 or have colored side contrast, as shown in FIGS. 25 to 28.

Referring to FIGS. 20 to 22, bracket (63) of the front sight has a relatively high forward portion (64) having the shape of a straight prism with a substantially square base and a serrated ramp (65) extending rearwardly therefrom. Bracket (63) has the lower face thereof milled lengthwise forming a shoulder (66) with a trapezoidal (dovetail) section adapted to be inserted into the notch (2) of rib (1), (FIG. 1), along which said bracket (63) can slide and be fixed in any position, by means of screw (67), inserted through hole (70) provided in the prismatic portion (64) extending into a transverse recess (69) formed in the lower face of the bracket (63). A key member (68) having beveled edges (68') corresponding to the side faces of slot (2) in rib (1), is positioned in the bracket recess (69) and is adapted to threadably receive the end of screw (67). Upon tightening screw (67), member (68) is pulled against the side faces of slot (2) in rib (1), thus causing the front sight bracket (63) to be firmly anchored in the desired position. In the upper face of the prismatic portion (64), a through notch (71) is milled having dovetail cross-section and it is adapted to receive the base of the inserts of the front sights. After being inserted in notch (71), the inserts are maintained in position by a detent provided by a ball (73) biased by a spring (72). Spring (72) bears on the bottom of hole (74), whose upper opening is given an annular deformation for preventing ball (73) from exiting completely from the hole.

As will be seen in FIGS. 23 and 24, the usual interchangeable inserts (75) of the front sight have an inverted T shape section. The horizontal base section (76) is insertable into the corresponding notch (71) of the front side bracket (63). The T's leg is formed by the rectangular section of rib (77) to which a plate (80) is fixed. Plate (80) is fixed on the front sight in a position slightly inclined backwards in order to avoid aiming reflections. The attachment of insert (75) to notch (71) of bracket (63) is made by pressure interference of ball (73) with a spherical or conical recess (79) formed in the insert base (76).

For changing the inserts, a pin is introduced into an aperture (78), extending through the rib (77) and communicating with the recess (79), urging ball (73) downwardly for releasing it from the interference with recess (79), thus permitting the insert (75) to slide forwardly or backwardly freeing it from notch (71). This operation is also performed for permitting access to screw (67) of bracket (63) in order to release it.

Another embodiment of the front sight insert is illustrated in FIGS. 25 to 28 wherein insert (81) is provided with colored side contrasts, and is formed by a straight prism whose base is identical to the outline of the highest portion (64) of bracket (63). In order to introduce insert (81) into notch (71) of bracket (63), as done with the usual inserts (75), the lower face of insert (81) is milled with a trapezoidal (dovetail) cross-section (82). The flat upper face (83) is bounded by the parallel vertical walls (85) having at the middle thereof, a protrusion (86) forming the front sight. In the recess between side walls (85) and protrusion (86), an acrylic member (87) is inserted to fully fill the recess. This acrylic member (87) is fixed in the insert base by a screw (90) introduced into a hole (89) open therein.

The rear face of walls (85) of said acrylic member and of the front sight (86) are milled forming a slightly backwardly inclined plane. Also, there is a hole (88) in the acrylic member (87) and in insert (81) to permit removal of the assembly from bracket (63), as noted above in connection with insert (75).

The purpose of the acrylic member (or of other material having similar optical properties), is to pick up luminosity from the upper or front environment in relation to the firearm, for transmitting it backwardly so as to form two luminescent rectangles (87) and the sides of the front sight (86). This will allow for a perfect "division" of the sight, which is essential for a good aiming, even when the target does not have a good background contrast (shooting black silhouette). This is due to the fact that perfect aiming requires that the front sight is exactly centered in relation to the rear sight notch and this is materialized by two identical bands (slits) of light (the target white) which should appear adjacent the front sight. When the target background is not white, the luminous color of the acrylic plays the same role, so as to maintain the same aiming conditions and uses of the shooter.

Figure 29:
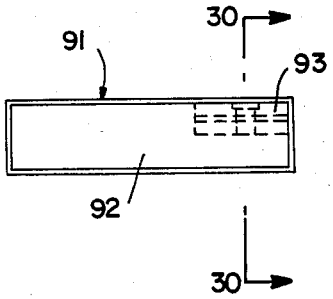
FIG. 29 is a side elevational view of an auxiliary weight.
Figure 31:
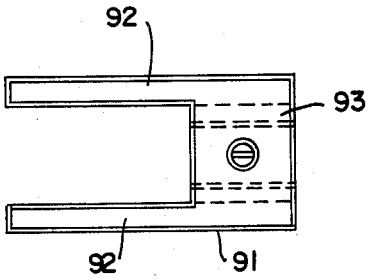
FIG. 31 is a top plan view of the auxiliary weight shown in FIG. 29.
Figure 30:
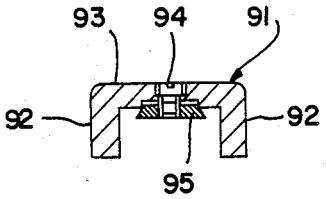
FIG. 30 is a view taken along line 30—30 of FIG. 29.

As explained above, the weight of rib (1) applied on the upper portion of the revolver raises the center of gravity thereof and exerts thereby a retraction compensating action for providing a great shooting stability. Despite this, an auxiliary weight (91), FIGS. 29 to 31, has also been provided whose cross-section has the shape of an inverted U, as formed by two parallel prismatic plates (92) joined by a bridge (93). The bridge is drilled for receiving a fastened screw (94) which is threaded in a plate (95) which has a trapezoidal (dovetail) cross-section and is engaged in a small recess in the lower face of bridge (93). After weight (91) and associated plate (95) are inserted into notch (2) of rib (1), it can slide therealong and be retained in the desired position by the shooter, by tightening screw (94) which will pull plate (95) against the side walls of notch (2). Therefore, the shooter has a further possibility of obtaining equilibrium of the firearm on his hand which seems to be more convenient and favorable to him.

Several modifications and variations of details in the present invention can be contemplated without departing from the main scope thereof, as mentioned in the attached claims.

I claim:

1. An aiming system adapted for use in competition revolvers enabling varied and broad adjustments, comprising, a heavy steel rib (1) having an upper face and a lower face, a first open notch (2) having a dovetail cross-section provided on said upper face, a rear sight and associated bracket (18), a front sight and associated barcket (63) and an auxiliary weight (91), said rear sights and said auxiliary weight being insertable in said upper face and fastened respectively therein at desired rear, front and medial positions, a second notch (10) have a dovetail cross-section provided in said lower face of said rib (1) and extending for a portion thereof from the front of said rib (1) toward the rear thereof, said second notch (10) having an extent corresponding to the length of the upper rib (14) of a revolver barrel (13), said second notch (10) being insertable on said barrel rib (14), the inner lower edges (11) of said rib (1) being machined to correspond to the barrel contour along the length thereof, the outer edges (12) of said rib (1) being chamfered in the same extent; the rear portion (8) of the lower face of the rib (1) having a rectangular cross-section adapted to engage the revolver bridge (15), the rear portion (8) having a forward wall (6) adapted to abut the face (16) of the bridge (15) upon insertion of said second notch (10) of said rib (1) onto the barrel (13), and screws (95, 96) for securing the rib (1) to said barrel (13), whereby the revolver and rib (1) are integrally connected; two identical scales engraved on the side face of said rib (1), said scales including a marking 220 followed by markings 1 to 5, reference indicia (63') and (18') on the respective brackets (63, 18) of the front sight and on the rear sight, said reference indicia being alignable with said scales, whereby when the reference indicia are placed coincident with identical markings in both scales, the sight distance or aiming base will correspond exactly to the 220 mm allowed by target shooting regulations; an opening (9) provided in the rear end portion of said rib (1), and an adjustment screw (27) extending through said opening (9) for vertical adjustment of the rear sight (26).

2. An aiming system sccording to claim 1, wherein the rear sight (26) and associated bracket (18) comprises a longitudinal shoulder (19) having a dovetail cross-section formed on the lower face of said bracket, thereby permitting the bracket (18) to be inserted and slid along the corresponding first notch (2) of rib (1), a slot (20) having a rectangular cross-section provided on the lower face of said shoulder (19), said slot being forwardly limited by a wall (21) and rearwardly by a wall (22), the screw (96) being inserted in said slot, said screw (96) being introduced into said slot by extending through a hole (17) in said bridge (15) and being threaded in a hole (7) in rib (1), the end of the secrew (96) limiting longitudinal movement of bracket (18) to the distance between walls (21) and (22), said bracket (18) being fastened at a desired position on the rib (1) by tightening said screw (96); a notch (25) milled in the rear portion of the upper face of bracket (18), said notch (25) being engaged by a narrow front portion of the rear sight (26), a screw (27) extending through said narrow portion for adjusting the height of said rear sight (26), said rear sight having a wider back prismatic portion (28) housing the mechanism for adjusting the direction and opneing of the rear sight notch; said mechanism comprising to transversely extending cylindrical bore (33) formed in said prismatic portion (28), an end wall provided on one end of said bore, a hole (34) formed in said end wall communicating with said bore, said hole (34) having a smaller diameter than said bore (33), the portion of the end wall surrounding said hole (34) being radially toothed, a flat wall (29) provided on the back of said prismatic portion (28), a horizontal slot (30) formed in said flat wall (29), said bore (33) and said hole (34) communicating with aid slot (30), the rear sight having a back plate divided into two symmetrical half plates (35, 39), wach plate having a half notch (36, 40) forming the rear sight opening, cylindrical bodies (38, 42) being mounted in said bore (33), ribs (37, 41) extending through and being guided by said slot (30), each rib connecting a cylindrical body to a respective half plate, said cylindrical bodies (38, 42) having threaded bores, the thread in the bore of one cylindrical body being in the opposite direction to the threaded bore in the other cylindrical body, a member (51) having spaced threaded end portions (53, 54) separated by a smooth portion (52), said member (51) being threadably mounted in said cylindrical bodies (38, 42), a threaded through-bore (56) formed in said member (51), a screw (45) threadably mounted in said bore (56) for horizontally adjusting said rear sight, said screw having a head (43) provided with a slot and an annular groove (44), said screw (45) having a blind bore (47) communicating with a pair of slots (46) formed in the end portion of said screw (45), a plate (49) slidably mounted in said bore and guided by said slots (46), and spring (48) mounted in said blind bore and biasing said plate (49) in a direction outwardly therefrom, a member (57) mounted in said cylindrical bore (33), teeth (61) provided on said member (57) adapted to be selectively engaged by the end of spring biased plate (49), two rods (58) connected to said member (57), a pair of slots (55) formed in the member (51) adapted to receive said rods (58), a helical spring (62) being biased between said member (57) and the outer end face of one of the cylindrical bodies (38), said member (57) having a head (60) extending into hole (34), an aperture (31) formed in a wall of said prismatic portion (28) in proximity to the annular groove (44) in the screw (45), a resilient pin (32) inserted into said aperture (31) engaging said annular groove (44) with an interference fit, thereby allowing the screw (45) to rotate but preventing it from axial movement, whereby when the serew (45) is rotated it will be screwed or unscrewed in the threaded through-bore (56) of member (51), causing said member (51) to displace leftwards or rightwards, said member (51) being integral with cylindrical bodies (36, 42) carrying half plates (35, 39) as a unit along slot (30); teeth (59) provided on member (57) adapted to engage the corresponding teeth provided on the protion of the end wall surrounding the hole (33), said spring (62) biasing the teeth (59), on member (57) against the teeth surrounding the hole (34), whereby members (51) and (57) are prevented from rotating during rotation of screw (45), whereby the direction of the rear sight can be adjusted; the opening of the rear sight notch being adjusted by biasing the head (60) of member (57) inwardly and rotating member (57), to thereby member (51) whereby the cylindrical bodies (38) (42) carrying the half plates (35, 39) are moved towards and away from each other.

3. An aiming system according to claim 1 wherein the front sight and associated bracket (63) comprises a relatively high forward portion (64) having the shape of a straight prism with a substantially rectangular base, a serrated ramp (65) extending rearwardly from the forward portion (64), a shoulder (66) having a trapezoidal section being milled along the entire lower face of the bracket adapted to be inserted in the forward portion of the first open notch (2) of rib (1), enabling the bracket (63) to be displaced therealong, a transverse recess (69) formed in the lower face of the bracket, a key member (68) adapted to be positioned in said recess (69), said key member (68) being configured to engage the notch (2) of rib (1), a screw hole (70) provided in the prismatic portion (64), a screw (67) adapted to extend through said hole (70) and threadably received in said key member (68), whereby the bracket (63) may be fixed in any desired position by tightening the screw (67), to thereby urge the key member (68) upwardly against the notch (2) of rib (1); a through notch (71) milled in the upppr face of the prismatic portion (64), said notch having a trapezoidal cross-section adapted to selectively receive the bases of interchangeable front-sight inserts, the bases of said interchangeable front sight inserts having trapezoidal cross-sectons adapted to be inserted into the notch (71) on prismatic portion (64) of bracket (63); detent means in the prismatic portion (64) of the bracket for releasably connecting a front sight insert to the bracket (63), said detent means comprising, a bore (70) in the prismatic portion (64), a ball (73) positioned in said bore, a spring (72) mounted in said bore urging said ball outwardly therefrom, a spherical recess formed in the base of the insert adapted to receive the spring biased ball detent for holding the insert on the bracket (63), and a hole aligned with said recess and communicating with the exterior of said insert, whereby a pin may be inserted into said hole to push the ball detent away from said recess, to thereby release the insert from the bracket.

4. An aiming system according to claim 3 wherein the front sight insert comprises a rectangular rib (77) extending upwardly from the base, and a plate (80) secured to one end of sawd rib forming the shoulder of the front sight.

5. An aiming system according to claim 3 wherein the front sight insert comprises, a pair of parallel, vertically extending side walls (85) integrally connected to the insert base (82), a rearwardly inclined shoulder (86) extending upwardly from the insert base (82), said shoulder (86) being spaced from and intermediate the side walls (85), the base (82) side walls (85) and shoulder (86) defining a recess, a material (87) having a different color than the base, side walls and shoulder being positioned in said recess, whereby the colored contrast between the shoulder (86) and material (87) facilitates the aiming of the revolver when the target is black.

6. An aiming system according to claim 1 wherein the auxiliary weight (91) comprises two prismatic plates (92) joined by a bridge portion (93) having a hole therein, a recess formed in the lower face of said bridge, a threaded plate (95) having a trapezoidal cross-section positioned in said recess and adapted to be inserted into the first open notch (2) of the rib (1) and slidable therealong, and a set screw (94) extending through said hole and threaded into said plate (95), whereby the wieght can be retained in a desired position by tightening screw (94) to pull plate against the notch (2).

* * * * *